US005638663A

United States Patent [19]

Robinson et al.

[11] Patent Number: 5,638,663

[45] Date of Patent: Jun. 17, 1997

[54] OVERHEAD CAN GUIDE

[75] Inventors: Glenn Robinson, Atlanta; Will L. Culpepper, Covington, both of Ga.

[73] Assignee: The Mead Corporation, Dayton, Ohio

[21] Appl. No.: 568,706

[22] Filed: Dec. 7, 1995

Related U.S. Application Data

[63] Continuation of Ser. No. 251,166, May 31, 1994, abandoned.

[51] Int. Cl.[6] ..... B65B 1/04

[52] U.S. Cl. ..... 53/473; 53/251; 53/252; 53/255; 53/259; 198/836.2; 198/457

[58] Field of Search ..... 198/456, 457, 198/836.1, 836.2; 53/251, 252, 255, 258, 259, 473

[56] References Cited

U.S. PATENT DOCUMENTS

| | | | |
|---|---|---|---|
| 3,034,270 | 5/1962 | Nigrelli et al. | 53/566 |
| 3,778,959 | 12/1973 | Langen et al. | 53/534 |
| 4,704,841 | 11/1987 | Langenbeck | 53/251 |
| 5,175,976 | 1/1993 | Petry et al. | 53/252 |
| 5,241,806 | 9/1993 | Ziegler et al. | 53/566 |

*Primary Examiner*—John Sipos
*Assistant Examiner*—Gene L. Kim
*Attorney, Agent, or Firm*—Michael V. Drew

[57] ABSTRACT

Guide blocks (20) having guide ribs (22) are moved by an endless chain (30) above and in synchronization with conveyor systems (11, 13) carrying groups (1) of containers. The guide blocks (20) and guide ribs (22) form channels for engaging the tops of containers in rows of an uncovered array (3) of respective groups (1) of containers as each group (1) of containers is pushed laterally across the conveyors (11, 13) into cartons (9) which are transported by a third conveyor system (15) which is also synchronized with the other conveyor systems (11, 13).

4 Claims, 5 Drawing Sheets

OVERHEAD CAN GUIDE

This is a continuation of Ser. No. 08/251,166 filed May 31, 1994, now abandoned.

BACKGROUND OF THE INVENTION

The invention relates generally to machines for loading side-loaded tubular cartons such as beverage cartons, and more particularly to a mechanism for stabilizing the tops of an array of containers such as beverage cans as the containers are loaded into a side-loaded carton.

One known method of loading containers such as beverage cans into a side-loaded carton is to push a group of the containers into an open end of the carton. The group of containers generally consists of at least one level of an array of containers (for example a 1×3, 3×4, or 4×4 array) or multiple tiers of arrays. Cartons and corresponding groups of containers to be loaded normally travel along side by side on respective parallel synchronized conveyors. Loading is performed as the cartons and groups of containers travel together side by side. Containers to be side-loaded are arranged in groups that are optimally accommodated by the carton. When loading a carton in the manner described above it is important that the individual containers of the group being loaded retain established positions in their group. If the containers shift position, tilt or topple while being loaded the loading process will be interrupted. The possibility of containers shifting position, tilting or toppling is increased when multiple tiers are being loaded. Containers of the uppermost tier of a multiple-tier grouping, or the lone level of a single-stack grouping, are uncovered and thus are most likely to shift position, tilt or topple because their movement is not inhibited by the weight of a higher tier of containers. What is needed is a means for inhibiting undesirable movement of containers of an uncovered array of a group of containers being loaded into a carton.

SUMMARY OF THE INVENTION

According to the main aspect of the present invention guide blocks with guide ribs travel on an endless chain above and in synchronization with a conveyor carrying groups of containers. The guide blocks and guide ribs form channels for engaging the tops of containers in rows of an uncovered level of respective groups of containers as a group of containers is pushed laterally into a carton.

Other advantages and objects of the present invention will be apparent from the following description, the accompanying drawings, and the appended claims.

DETAILED DESCRIPTION OF THE PREFERRED EMBODIMENT

Figure 1:
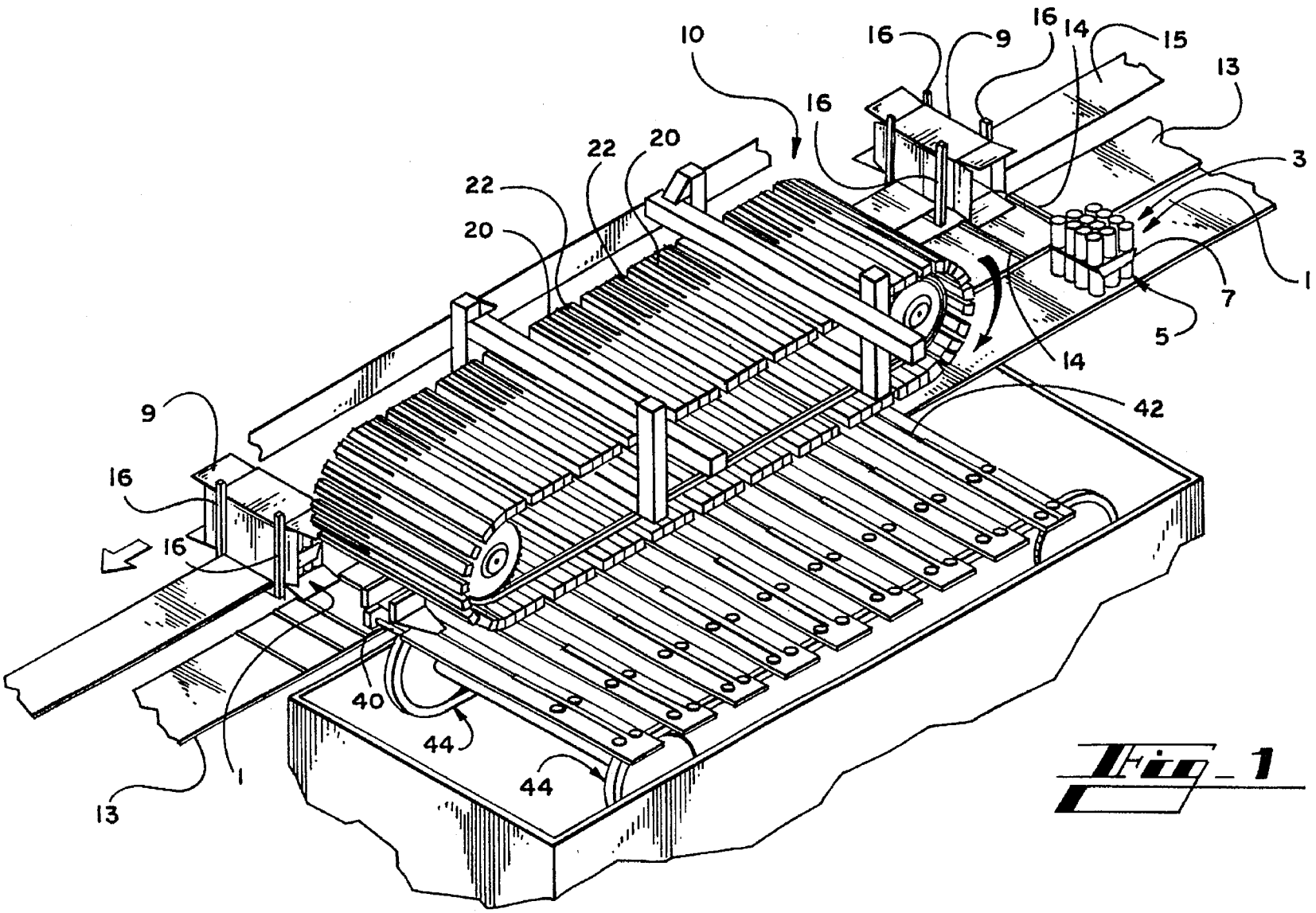
FIG. 1 is an isometric view of an overhead can guide according to a preferred embodiment of the invention in conjunction with a portion of a typical side-loading cartoning machine.

Throughout the figures the same reference numerals are used to refer to identical features of the preferred embodiment illustrated. Referring first to FIG. 1, therein is shown an overhead can guide 10 according to a preferred embodiment of the invention. The overhead can guide mechanism 10 is shown in conjunction with a portion of a typical cartoning machine for end-loaded cartons. In the typical application illustrated, a group 1 of cans arranged in multiple tiers 3, 5 separated by a divider panel 7 is positioned for insertion into an end-loaded carton 9. The group 1 of cans is illustrated positioned upon one of three conveyor systems 11, 13, 15 in alignment with a carton 9 contained upon the carton conveyor system 15. In the cartoning machine illustrated the group 1 of cans initially travel upon a conveyor system 11 which brings the cans from a feeder mechanism. Not shown and not pertinent to this discussion are flight bars which aid in movement of the groups 1 of cans along the first conveyor system 11. The group 1 of cans is then pushed onto and transported by a second, or intermediate, conveyor system 13. Lower can guides 14 on the intermediate conveyor system 13 help maintain the position of the group 1 of cans on the moving system 13. The second conveyor system 13 moves the group 1 of cans in side-by-side alignment with the carton 9 carried upon the third conveyor system 15. The carton 9 is moved along the third (carton) conveyor system 15 by lugs 16. The group 1 of cans is subsequently pushed into the carton 9. In general, the three conveyor systems move in synchronized motion so that the group of cans may be smoothly transferred from one conveyor system to the other. Pusher bar 40 at the end of pusher rods 42 push the cartons 9 from one conveyor system to another. The pusher bar 40 and rods 42 are moved by an endless chain system 44 also in synchronization with the conveyor systems 11, 13, 15. The essential components of the mechanism 10 are a number of guide bars 20 arranged in belt-like fashion upon an endless chain. Each guide bar 20 has a guide rib 22 at one end.

Figure 2:
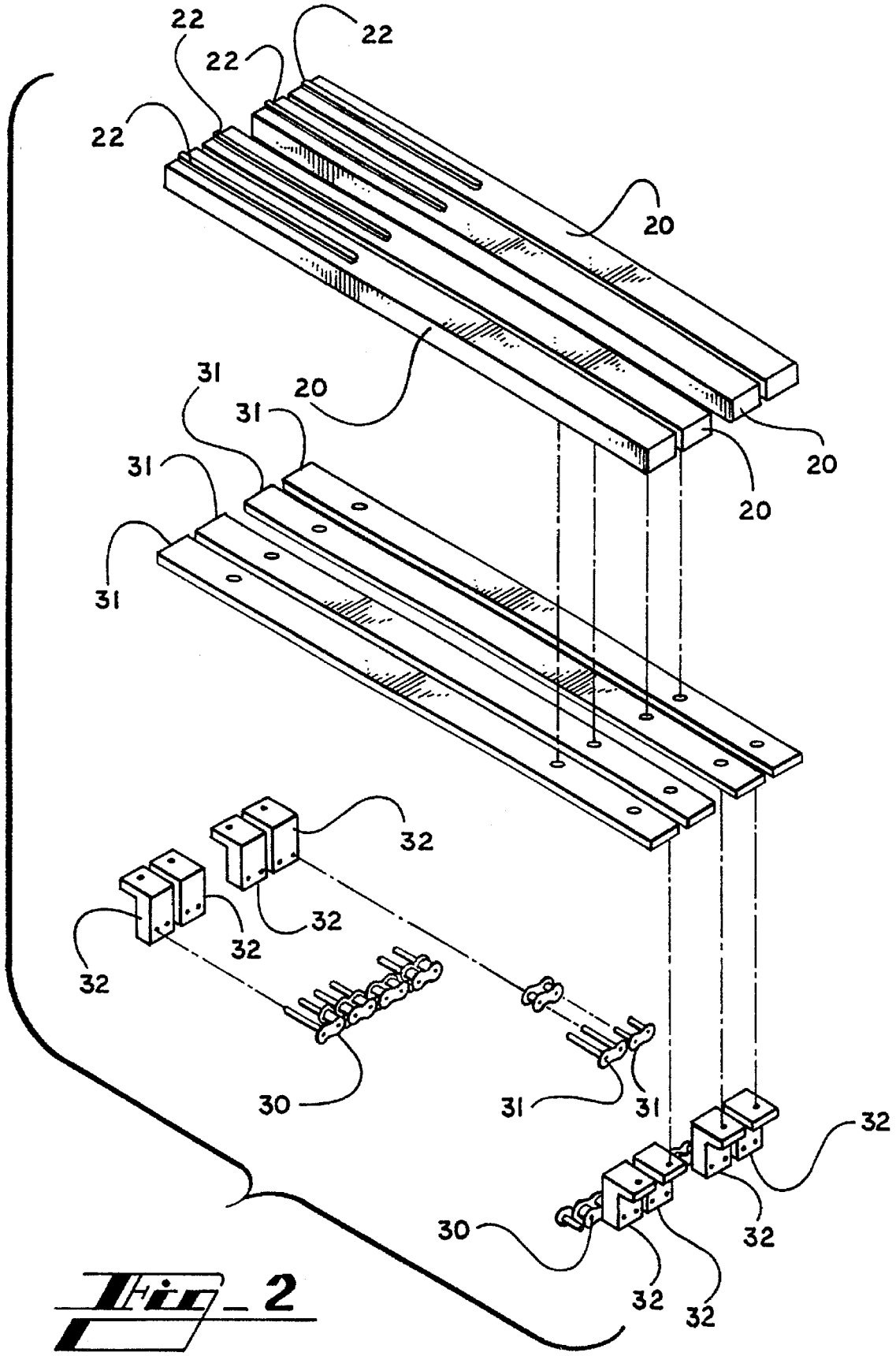
FIG. 2 is an exploded view of the primary components of the overhead can guide of FIG. 1.

Referring now to the exploded view of FIG. 2, the components of the guide mechanism 10 may be seen in greater detail. The guide bars 20 and guide ribs 22 form channels consisting of the surfaces of the bars 20 and the ribs 22 upon pairs of adjacent guide bars 20. The guide bars 20 are mounted upon the endless chain 30 by means of trucks 32 affixed to the links of the chain 30. Mounting links 31 secure the trucks 32 to the endless chain. Mounting plates 34 attached to the trucks 32 support the guide bars 20.

Figure 3:
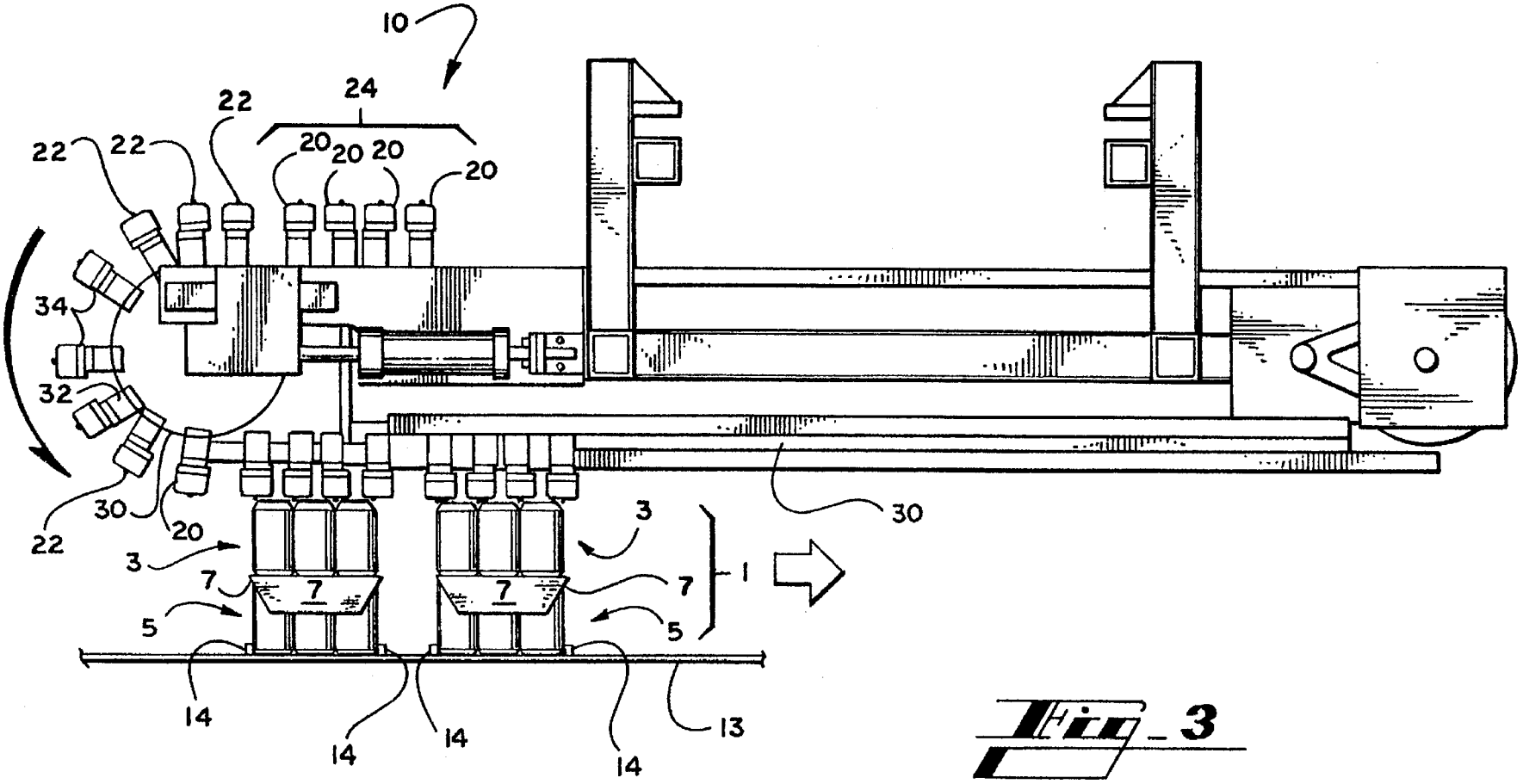
FIG. 3 is a side elevational view of the overhead can guide of FIG. 1.
Figure 4:
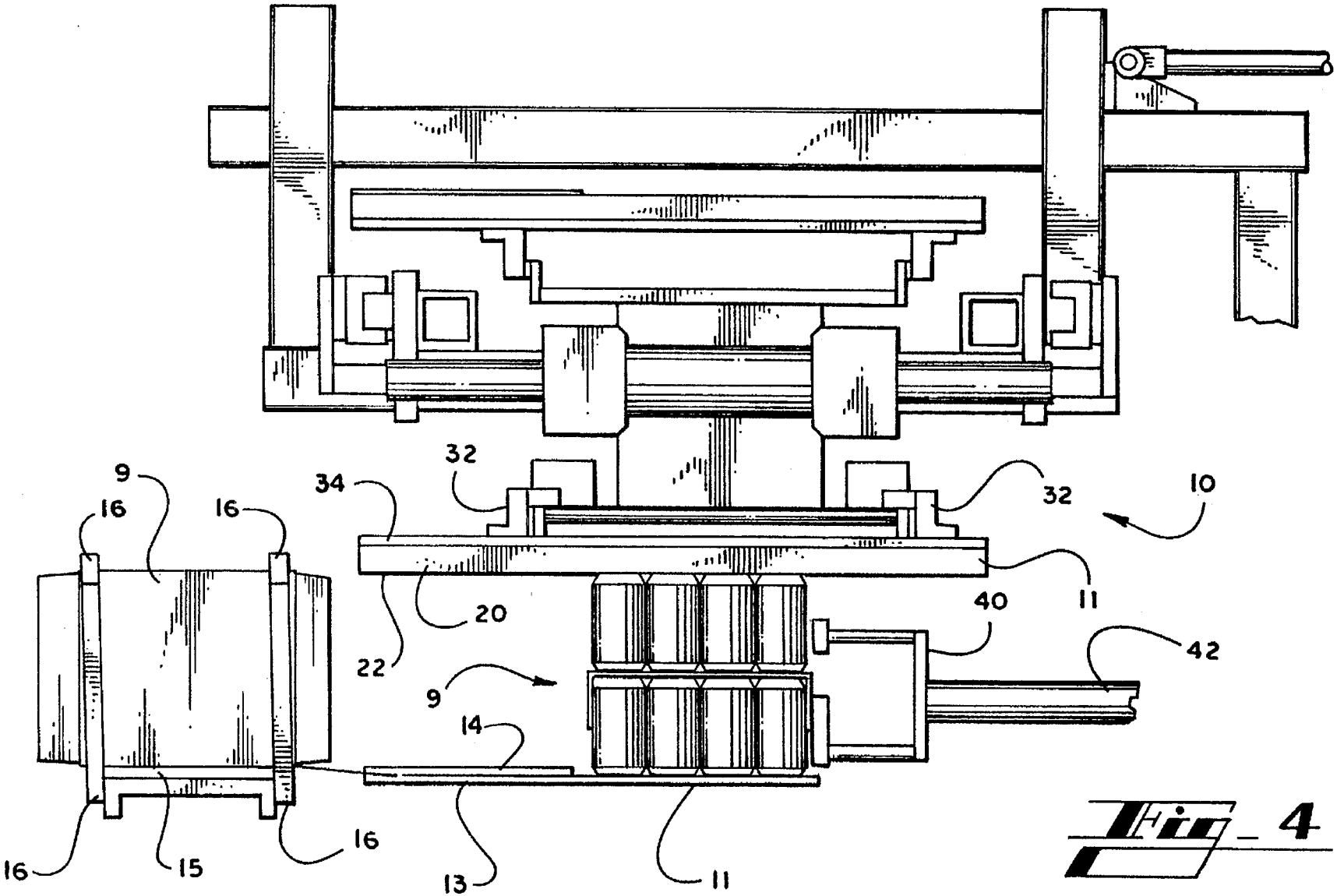
FIG. 4 is a sectional view of the overhead can guide of FIG. 1 and is the first of the series of illustrations of FIGS. 4 through 6 illustrating loading of a group of cans into a carton facilitated by the overhead can guide of FIG. 1.
Figure 5:
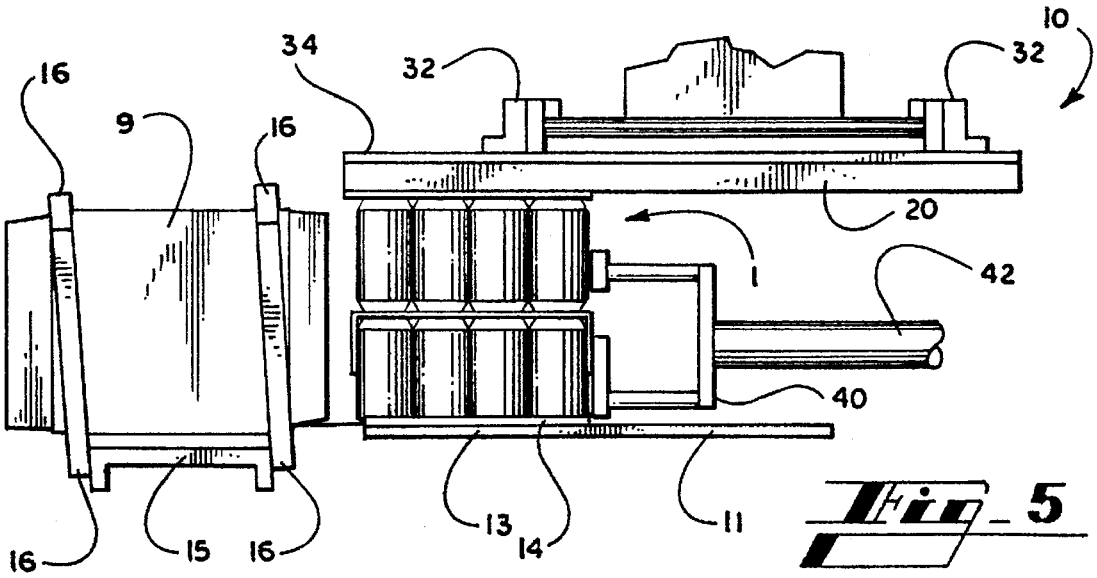
FIG. 5 is the same sectional view as FIG. 4 with the cans fully engaged by the overhead can guide.
Figure 6:
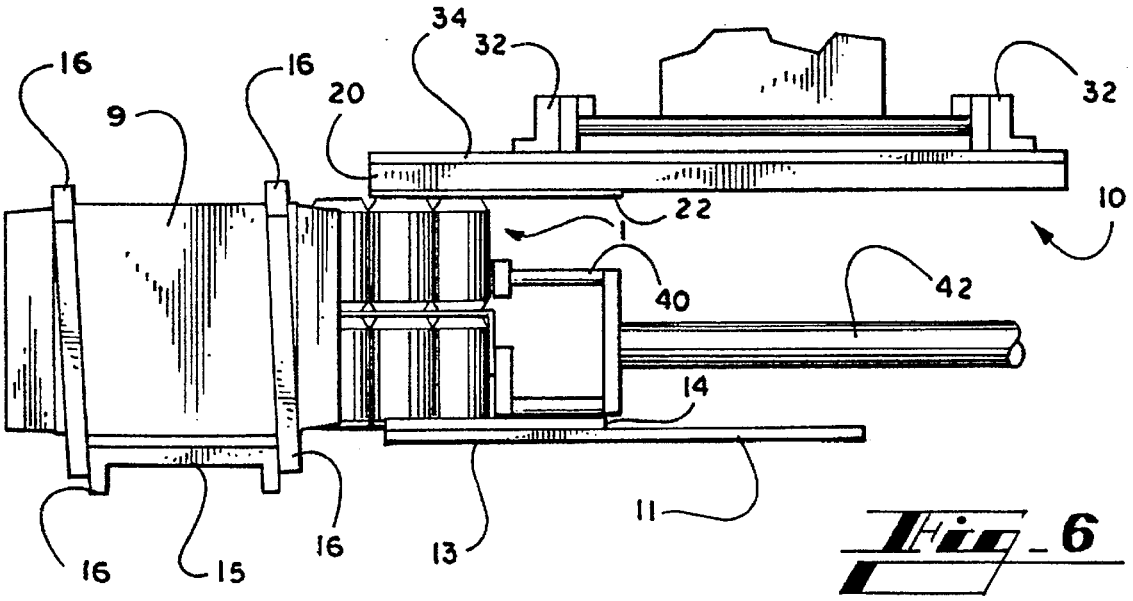
FIG. 6 is also the same sectional view as FIG. 4 with the group of cans partially inserted into the carton.
Figure 7:
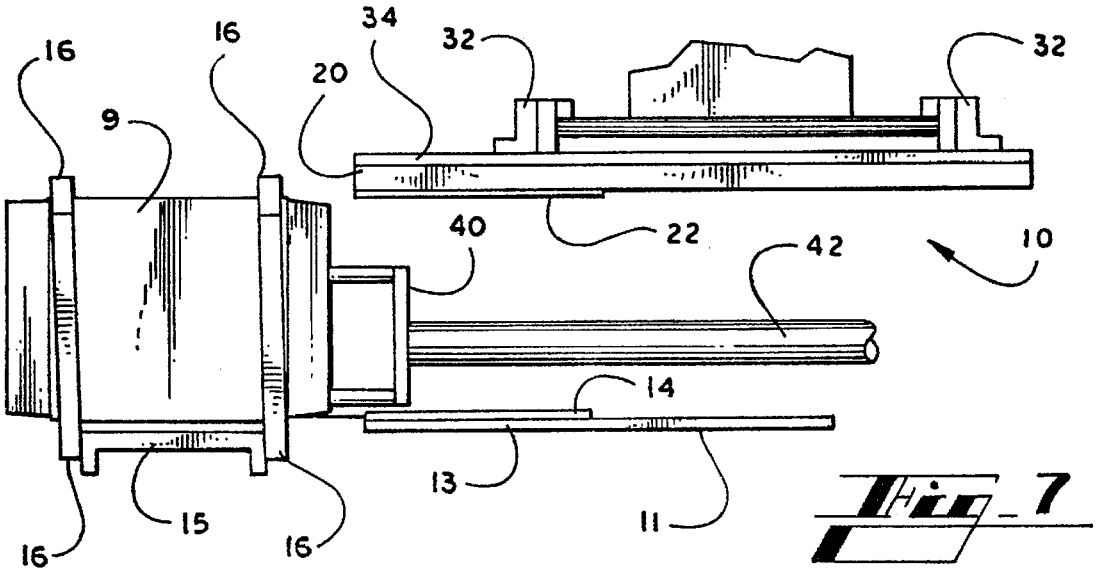
FIG. 7 is again the same sectional view as FIG. 4 with the group of cans fully loaded through use of the overhead can guide.

Referring now to FIG. 3, therein is illustrated in an elevational view the manner in which the elements of the mechanism 10 align with the group 1 of cans to be stabilized. The guide bars 20 are shown mounted upon the endless chain 30 which supports and moves them. Groups 24 of guide bars 20 are spaced apart so that each group 24 may engage a distinct group 1 of cans. In each group 24, the bars 20 and ribs 22 form channels for receiving the tops of cans in rows of the uppermost tier 3 (the uncovered level) of the can group 1.

Referring now to FIGS. 4 through 7, therein are illustrated in a frontal sectional view the manner described above in which the group 1 of containers is pushed by the pusher bar 40 and rod 42 from the first conveyor system 11 onto the second conveyor system 13 and under the overhead can guide mechanism 10, and ultimately into the carton 9 upon the carton conveyor system 15. FIGS. 4 through 7 and FIG. 3 illustrate that as the container pusher bar 40 pushes the group 1 of containers from the first conveyor system 11 until finally inserted into the carton 9, the channels formed by the bars 20 and ribs 22 inhibit movement of the cans 3 of the uncovered array in all directions except for the direction of movement of the pusher bar 40 and rod 42. The force imparted by the pusher mechanism 40, 42 prevents movement of the uncovered tier of cans 3 in the direction opposite to the pusher's 40, 42 direction of movement. The momentum imparted to the group 1 by the pusher 40, 42 will generally negate any shifting, tipping or toppling motion of the cans 3 that would otherwise occur in a direction toward the carton 9. The close proximity of a pair of adjacent guide bars 20 to the top of a can 3 prevents the cans from tilting or toppling laterally with respect to the conveyor systems 11, 13. The other possibilities of directions of can 3 movement are in the downstream and upstream directions of conveyor movement. But the ribs 22 inhibit tilting or toppling in those directions. Thus, the guide mechanism 10 inhibits the cans of the uncovered tier 3 from shifting, tilting or toppling.

Other modifications may be made in the foregoing without departing from the scope and spirit of the claimed invention. For example, although the invention has been illustrated and described with respect to cans the invention is equally applicable to bottles or any other type of container having a top which can be received in and slid through a channel to prevent the container from shifting position, tilting or toppling. Also, although the invention has been particularly described as being applicable to the loading of end-loaded cartons, the invention is applicable to any instance in which containers are being pushed from one conveyor system to another. Further, although the invention has been illustrated and described with respect to a multiple-tiered group 1 of cans the invention is equally applicable to a single level, or stack, of cans forming an array. The elements of the guide mechanism 10 described above inhibit the containers in a single-level array from shifting, tilting or toppling when being pushed.

What is claimed is:

1. A method for loading groups of upstanding elongated articles into cartons wherein each group of upstanding elongated articles has at least one uncovered level of upstanding elongated articles arranged in an array comprising:

transporting the groups of upstanding elongated articles upon a first article conveyor such that parallel rows of the array are transversely disposed with respect to the direction of movement of said first conveyor;

transporting the cartons upon one of at least one second successive conveyor, said at least one second successive conveyor being adjacent and moving in synchronous parallel motion with said first article conveyor;

providing channel forming structure moving in synchronous motion in relation to and disposed in parallel relation above said first article conveyor and said at least one second successive conveyor, forming groups of transverse parallel channels that respectively correspond to the rows of the array and receive topmost ends of the upstanding elongated articles of the uncovered level of the upstanding elongated articles arranged in the array generally restricting movement of the upstanding elongated articles to the direction in which the upstanding elongated articles are pushed; and urging at least two of said parallel rows of upstanding elongated articles from said first conveyor onto said at least one second successive conveyor and into each ones of the cartons such that said topmost ends of said upstanding elongated articles of each of said rows of the array translate in respective said transverse parallel channels.

2. The method of claim 1, wherein said groups of transverse parallel channels are formed by groups of a plurality of elongated members transversely mounted upon an endless chain, each of said elongated members having a rib projecting from a support surface whereby within each said group of elongated members parallel U-shaped channels are formed by said ribs and said support surfaces of adjacent ones of said elongated members.

3. A system for loading groups of upstanding elongated articles into cartons wherein each group has at least one uncovered level of upstanding elongated articles arranged in an array of at least two rows comprising:

a first article conveyor for transporting the groups of upstanding elongated articles with said rows transversely disposed with respect to the direction of movements of said first conveyor;

at least one successive second conveyor adjacent said first article conveyor moving in synchronous parallel motion therewith for receiving and transporting the groups of upstanding elongated articles;

an article transport assembly disposed in cooperative relation to said first article conveyor and said at least one successive second conveyor for urging at least two rows of upstanding elongated articles transversely from said first article conveyor onto said at least one successive second conveyor and into each of said cartons; and p1 channel forming structure including groups of a plurality of elongated members transversely mounted upon an endless chain moving in synchronous motion in relation to and disposed in parallel relation above said first article conveyor and said at least one successive second conveyor, each of said elongated members having a rib projecting from a support surface whereby within each said group of elongated members U-shaped channels are formed for each row of articles by said ribs and said support surfaces of adjacent ones of said elongated members.

4. The system of claim 3, wherein within each of said groups of a plurality of elongated members said rib of each of at least two adjacent ones of said plurality of elongated members is disposed mediate side edges thereof.

* * * * *